United States Patent [19]

Eiselt

[11] 4,065,910

[45] Jan. 3, 1978

[54] METHOD OF AND DEVICE FOR PACKAGING BLOCKS OF FOAMED SYNTHETIC MATERIAL

[75] Inventor: Günter Eiselt, Unkel, Germany

[73] Assignee: Recticel Deutschland Kunststoffe GmbH, Rheinbreitbach, Germany

[21] Appl. No.: 717,167

[22] Filed: Aug. 24, 1976

[30] Foreign Application Priority Data

Sept. 4, 1975 Germany ..... 2539289

[51] Int. Cl.[2] ..... B65B 63/02

[52] U.S. Cl. ..... 53/24; 53/124 B; 53/124 D; 100/44; 100/220

[58] Field of Search ..... 53/24, 124 B, 124 D; 100/44, 220

[56] References Cited

U.S. PATENT DOCUMENTS

| | | | |
|---|---|---|---|
| 3,319,394 | 5/1967 | Talalay et al. | 53/24 |
| 3,516,217 | 6/1970 | Gildersleeve | 53/24 |
| 3,824,759 | 7/1974 | Finn et al. | 53/24 |

FOREIGN PATENT DOCUMENTS

| | | | |
|---|---|---|---|
| 1,156,860 | 7/1969 | United Kingdom | 53/24 |

*Primary Examiner*—Travis S. McGehee
*Attorney, Agent, or Firm*—Walter Becker

[57] ABSTRACT

A method of and a device for packaging blocks of foamed synthetic material in which a pair of parallel plates are mounted on a frame and are movable toward and away from each other for compressing blocks of resilient material therebetween. The machine may include blocking members for holding the articles in compressed condition and is adapted for receiving a package in which the articles can be compressed and which is provided with a releasable closure element at one end.

10 Claims, 4 Drawing Figures

METHOD OF AND DEVICE FOR PACKAGING BLOCKS OF FOAMED SYNTHETIC MATERIAL

The present invention relates to a method of and device for packeting blocks of foamed synthetic material. For purposes of saving transportation costs when transporting blocks of foamed material, it is known to transport such blocks in so-called press-trucks. These press-trucks have a roof which can hydraulically be moved upwardly and downwardly so that blocks of fomed material loaded into the truck when the roof is in its raised condition can by lowering the roof be pressed together to about fifty percent of their volume and can be transported in this condition. Aside from the fact that such press-trucks are relatively expensive, it has been found that the blocks of foamed material compressed in this manner have for various reasons frequently not been uniformly compressed over the entire available space but that the total quantity of the loaded foam material may be in differing conditions of compression. One reason for this non-uniformity of compression consists in that during the compression of the blocks of foamed material in the truck there may be encountered different frictional resistances within the region of the side walls of the truck. A further reason for the above mentioned non-uniformity may consist in that the total of the foamed material to be loaded into such press-truck is not completely homogeneous with regard to its inner structure and its mechanical properties.

In view of the forces acting on the foamed material for the above outlined reasons and locally greatly varying over the total space of the truck filled with the foamed material, the essential properties of the foamed material which are important for the further processing of the foamed material likewise vary to a considerable degree. In this connection it is known that in view of the action of a certain pressure effective over a certain period of time, in addition to other properties also the ability of the foam material to return to its original shape is changed. Thus, among others the undesired consequence may result that when producing, for instance, pillows or mattresses of identical size from a foam material compressed in a press-truck the elasticity of such pillows or mattresses may vary to a high degree.

It is, therefore, an object of the present invention, for the transport in compressed condition of foam material so to compress the blocks of foam material that structural changes in the foam material, which changes are unavoidable due to the compression and the maintaining of the compression over a long period of time, will occur uniformly over the entire mass of the blocks of compressed foam material.

It is another object of this invention to provide a method as set forth in the preceding paragraph which will make it possible to permit the above mentioned changes to take place to a predetermined extent already prior to the processing of the foam material so that shaped bodies, such as mattresses and pillows, produced from such blocks of compressed foam material will not materially change their resilient properties, their basic hardness and other essential properties when in use.

These and other objects and advantages of the invention will appear more clearly from the following specification in connection with the accompanying drawings, in which.

Figure 1:
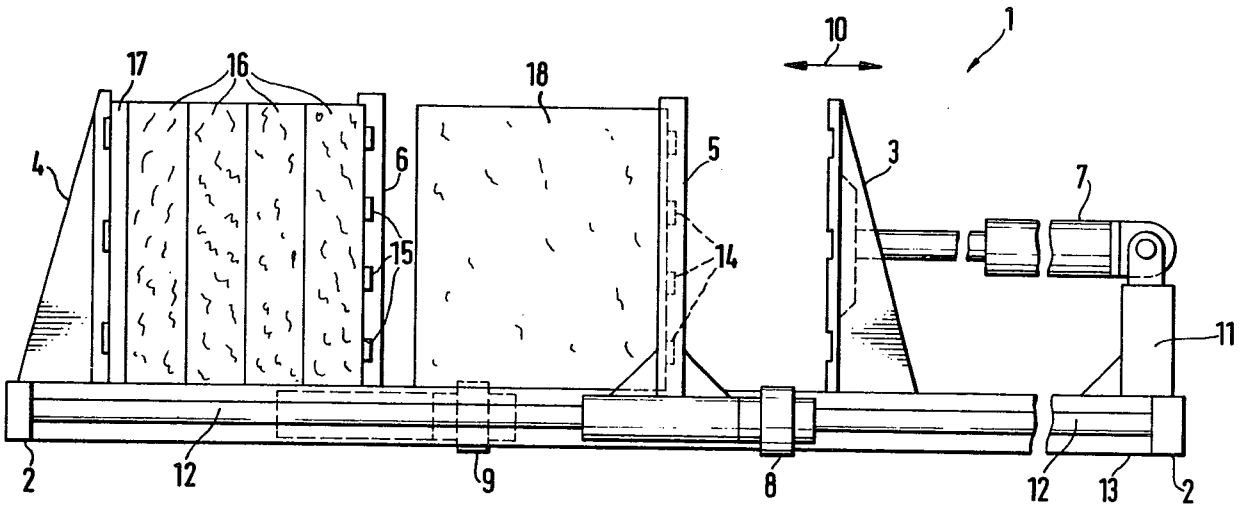
FIG. 1 illustrates one possible embodiment of a device for practicing the method according to the invention, the device being shown in one side view.

The method according to the invention for packeting blocks of foamed synthetic material, especially soft elastic foamed material, is characterized primarily in that individual blocks are either compressed individually or as layers of a plurality of blocks, for instance in layers of two blocks, the compression being effected to a predetermined degree, whereupon the blocks are stacked in compressed condition and are finally combined to packets.

A device for practicing the method according to the invention is characterized primarily by a press-frame with two press plates or the like which are located in parallel planes and which are guided relative and vertically with regard to each other. At least one of the press plates is engaged by driving means for controllably driving the same. The device according to the invention is furthermore provided with movable blocking elements which are displaceably guided by the pressing device on the press frame and are adapted to be arrested against accidental displacement. The blocking elements are also movable transverse to the pressing direction in the space between the press plates.

According to a further development of the device according to the invention, the blocking elements are displaceably guided in the frame transverse to the pressing direction while the blocking elements are displaceable in pressing direction on stationary guiding means.

According to a still further development of the device according to the invention the blocking elements have finger-like extensions or the like which are spaced from each other by a distance which corresponds to the mutual spacing of openings, recesses, perforations or the like provided in the side walls of the containers for packeting the blocks of foam material, the containers being provided on a press frame.

Another possibility of designing the control of the blocking elements for a device of the invention consists in that the blocking elements are displaceable in pressing direction on guiding bars and are movable for pivoting about the guiding bars.

According to a still further development of the device according to the invention there are provided containers of predetermined length which are associated with the press frame of the device according to the invention. Such containers have at least one closable charging opening which is designed to conform to a movably guided press plate of the press frame. The container furthermore has side walls which define the cross section of the container and which have openings, recesses, perforations, or the like to permit the passage of the blocking elements of the press frame. Preferably, such container is characterized in that it has at least one end provided with door means equipped with locking elements. Expediently, the door means have associated therewith brake means for obtaining a desired slow opening of the door means after the locking elements have been disengaged. In this way too fast an opening of the door means and consequently an unduly fast shocklike escape from the container of the foam blocks which are under considerable pressure will be prevented.

Referring now to the drawings in detail, FIG. 1 illustrates a press for practicing the method according to the invention. The press of FIG. 1 comprises primarily a stationary press frame 2, press plates 3 and 4, blocking elements 5, 6, and driving means 7, 8 and 9 for the press plate 3 and the blocking elements 5 and 6 respectively. According to the embodiment of the invention as shown in the drawings, the press plate 4 is fixedly connected to the press frame 2. The press plate 3 is movably guided in the direction of the arrow 10 toward the press frame. As driving means 7 for the press plate 3 there is provided a hydraulic drive. The hydraulic drive rests on a support 11 which is firmly connected to the press frame 2. At both sides of the press frame 2 there is provided a blocking element 5 and 6 respectively. The blocking elements 5 and 6 are displaceably guided on a guiding bar 12 and 13 respectively and by non-illustrated arresting means may be arrested in any desired position. Furthermore, the blocking elements 5 and 6 are pivotably mounted on the guiding bar 12 and 13 respectively in such a way that the holding plates 14 and 15 respectively mounted on the blocking elements 5 and 6 can be completely tilted out of the region of the pressed foam blocks 16. Driving means 8 and 9 are respectively provided for pivoting the blocking elements 5 and 6.

The method according to the invention may be practiced with the embodiment of the device as shown in FIG. 1.

Between the press plates 3 and 4 of press 1 there is moved a non-pressed foam block 18, expediently by interposing a supporting plate or the like 17 between the foam block 18 and the press plate 4. The supporting plate 17 may be made, for instance, of a wood material, for instance may be a so-called plywood plate. Between the press plate 3 and the respective foam block 18 to be pressed there will be introduced one of the two blocking elements 5 and 6. This blocking element must be relieved or disengaged prior to the pressing operation so that it will be movable in the pressing direction indicated by the arrow 10. Thereupon, the driving means 7 for the press plate 3 is controlled in such a way that the introduced foam block will be compressed to about from 10 to 30% of its original volume. The mentioned blocking element and holding plate respectively of the respective blocking element are located on that side of the now pressed foam block 16 which faces away from the press plate 4. In this position, the respective blocking element is secured against accidental displacement. Subsequently, a further foam block 18 is introduced into the press. This foam block 18 is located between the above mentioned one blocking element and the press plate 3. Between the press plate 3 and the newly introduced foam block 18 there will now the other blocking element be pivoted into the press chamber whereupon a further pressing operation is effected. In this connection, the driving means 7 is again controlled in such a way that the newly introduced foam block 18 is reduced to at least a considerable portion of its volume, for instance, up to about 50% of its volume. Subsequently thereto, the blocking element which is located between the first pressed and the subsequently pressed foam block 16 is pivoted out of the press chamber by means of the respective driving means 8 and 9 so that the two foam blocks will now be located directly adjacent to each other. Thereupon the last introduced foam block may by correspondingly controlling the driving means 7 for the press plate 3 be compressed further to a desired extent. After the completion of this pressing operation, the last pivoted-in blocking element is latched so that the press plte 3 can be returned to its starting position. The subsequent pressing operation will be effected in the same manner as the preceding pressing operation and again while employing the first mentioned blocking element.

If the foam blocks are to be pressed with a relatively slight extension in the pressing direction, it is also possible, instead of only one foam block, to compress a layer of a plurality of foam blocks, for instance two foam blocks, in a single pressing operation without the advantages of the method of the invention upon the structure and properties of the foam material being affected in any material manner.

In order to exploit these advantages of the method according to the invention it should, however, be borne in mind that the dimensions of the respective foam blocks or layers of foam blocks to be compressed should not exceed a certain magnitude which is determined by the dimensions of the bodies, for instance mattresses, to be produced later from the foam blocks. It will be appreciated that in case of foam blocks to be compressed to too great a degree there would exist the danger that, similar to the above mentioned prior art press-trucks, structural differences in the foam material occur or occur even to an increased degree. As cover for a packet of pressed foam blocks 18 produced in the above mentioned manner, again a supporting plate 17 may be used so that the packet of pressed foam blocks can be held in compressed condition by means of metal bands, or the like packing means, and can be transported, for instance, on an ordinary truck.

In case of an embodiment of a device suitable for practicing the method according to the invention, the press generally designated 20 comprises primarily a press frame 21 with blocking elements 22 and 23. These blocking elements are through the intervention of guiding means 29 and 30, and 31, and 32 mounted in C-shaped frames 28 for displacement in vertical planes. Similar to the device of FIG. 1, with the device of FIG. 2 there are provided two frames 28 with blocking elements 22 and 23 and more specifically in two planes which are parallel to each other. Each of the two frames 28 is longitudinally displaceable on guiding bars 37–40 which are connected alongside the press frame, and are arrestably mounted in a desired position. The blocking elements 22 and 23 comprise finger-shape extensions 35, 36 the free ends of which are in the condition of the blocking elements 22 and 23 shown in the drawing arranged opposite and closely adjacent to each other. The blocking elements 22 and 23 are drivingly connected to a piston rod 33 and 34 respectively, which piston rods form part of a driving means 24, 25 respectively. The driving means 24 and 25 designed as hydraulic motors are to a certain extent pivotally mounted in bearings which are not specifically designated and which are located at those ends of supports 26,27 which face away from the press frame 21.

Figure 3:
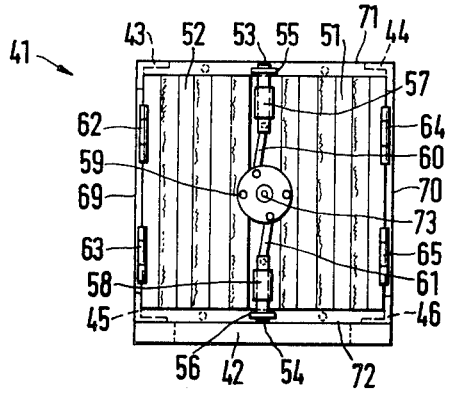
FIG. 3 is a front view of a container for use in connection with the device of FIG. 2 for packeting blocks of foam material.
Figure 4:
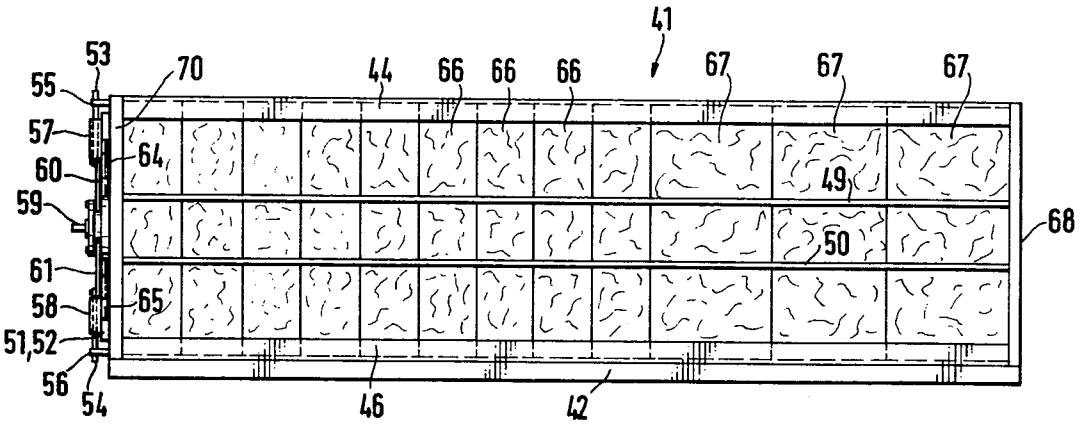
FIG. 4 shows the container of FIG. 3 in side view.

Within the press frame 21 there is provided a container 41 which serves as transport and stock keeping package for foam material pressed, stacked and packeted in conformity with the method of the present invention. Pressed foam blocks 16 are stacked in the container 41 after they have been compressed. For purposes of obtaining a sufficient rigidity, the container 41 includes a continuous frame 42. The container 41 consists primarily of corner profiles 43, 44, 45 and 46 and of bars 47, 48, 49 and 50 and also of similar bars not specifically designated and also compress door elements 51 and 52 and finally a rear wall 68. The door elements 51 and 52 are through the intervention of hinges 62 and 63 and 64 and 65 respectively linked to frame parts 69 and 70 respectively of the container 41. Guided on the door element 51 in guiding means 57 and 58 are latches or locks 53, 54 which correspond to the holding means 55 and 56. These holding means are fixedly connected to frame sections 71 and 72 respectively of the container 41. The locks 53 and 54 are furthermore through the intervention of guiding means or guiding rods 60,61 respectively coupled to an actuating means 59, said actuating means being to a certain extent pivotally or rotatably mounted on a bearing 73 provided on the door element 51. The operation of the device according to the embodiment in FIG. 2 in combination with a container as illustrated in FIGS. 3 and 4 is substantially the same as that of the device according to FIG. 1. Instead of pivotable blocking elements, however, according to FIG. 2 the blocking elements 22 and 23 are not pivotable about axes but are displaceable rectilinearly along guiding means 29 and 30 and 31 and 32 respectively. In the dot-dash position of the blocking elements 22 and 23, spring-like extensions 34 and 36 are arranged outside the clear cross section of the container 41, said extensions 35 and 36 respectively being associated with said blocking elements. In this position of the blocking elements 22 and 23, the respective frame 28 with blocking elements 22 and 23 may for purposes of compressing a further foam block 18 be displaced to a corresponding extent along the press frame 21 and after the completed pressing operation can be arrested for a desired time.

Figure 2:
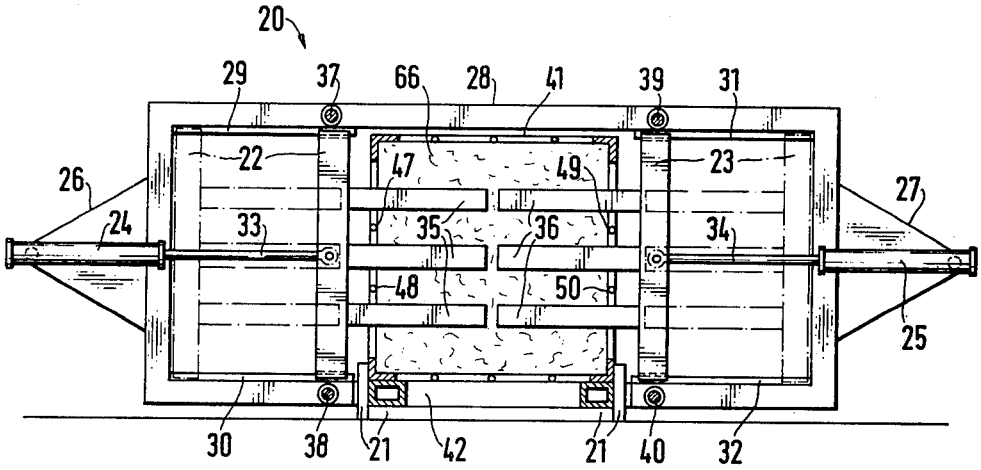
FIG. 2 shows a front view, partly in section, of another embodiment of the device according to the invention.

It will be evident from FIG. 2, that the finger-shaped extensions 35 and 36 extend through openings, recesses, perforations or the like of the container 41 which openings or the like are formed by corner profiles 43, 44, 45, 46 and bars 47, 48, 49 and 50.

Due to its relatively great length and its relatively great weight, a container 41 is preferably by means of suitable servodevices, for instance by means of cable winches or the like moved into the press 20 are respectively into the press frame 21 and moved out again in this way from the press frame 21.

After the foam blocks 18 have been compressed in conformity with the invention to form pressed foam blocks 66, 67, and after these pressed foam blocks have been stacked in the container 41, after corresponding filling of the containers 41, the door elements 51 and 52 are closed by means of the latches 53 and 54 by a corresponding operation of the actuating means 59. In this connection, it should be noted that the door elements 51 and 52 are in open condition during the successive pressing operations in order that the press plate which is not shown in FIG. 2 and which corresponds to the press plate of FIG. 1, will be freely movable within the free cross section of the container 41. A press plate corresponding to the press plate 4 of the device of FIG. 1 may with the device of FIG. 2 be omitted if desired because a container 41 has a firm rear wall 68.

As will be evident from the above, by means of the method and device according to the present invention, foam blocks can be pressed to a packet with a plurality of foam blocks without any sections of the resulting foam packet being exposed to loads which differ from the loads in adjacent sections. The foam packets according to the invention can thus be transported at a minimum of cost without the drawbacks which may be encountered with heretofore known press trucks. While the structural homogeneities of the foam material which are generated by the compression or are only increased thereby in the heretofore known press trucks at a compression of the foam material by 50% may be considerable, it will be appreciated that when employing the method according to the invention, the foam material can be compressed to a far greater extent while the foam material or each individual foam block will nevertheless practically completely uniformly be stressed by the pressing operation and if desired will be changed in its structure uniformly to a certain extent.

Furthermore, the pre-determined occurring structural changes of the foam material which are substantially uniform over a foam load consisting of a plurality of blocks, can be obtained with regard to the normal transport and storing time of the foam in pressed condition when the foam blocks are compressed to from 10 to 30% of their starting volume.

Furthermore, it has been found that with regard to uniformity of the end products, for instance mattresses, it is advantageous that the foam blocks are compressed in that direction which is characterized by the direction of the rising foam during the manufacture of the foam material. The production of soft elastic foam material is known, and therefore need not be discussed herein.

It is, of course, to be understood that the present invention is, by no means, limited to the specific showin in the drawings, but also comprises any modifications within the scope of the appended claims.

What is claimed is:

1. The method of packaging block like articles of foamed elastic material to reduce transporting costs thereof which comprises in combination the steps of: arranging the articles in face to face engagement and in alignment, compressing the articles individually in the direction of alignment thereof to assure stable characteristics thereof, stacking the individually compressed articles in compressed condition, and finally enclosing the individually compressed articles in a package.

2. The method in combination according to claim 1 in which each article is compressed individually by about 70 to 90 per cent of the normal dimension of the article in the said direction of alignment of the article.

3. The method in combination according to claim 1 in which the articles are formed by foaming a material in a principal direction, said compressing of each article individually taking place in the same principal direction.

4. An apparatus for the compression of resilient foamed articles to reduce transporting costs thereof and comprising in combination; a press frame, a pair of press plates upstanding from the press frame in spaced parallel relation for receiving the articles individually to be compressed therebetween to assure stable characteristics thereof, means for moving said press plates toward and away from each other, blocking elements on said press frame displaceable thereon in the pressing direction of relative movement of said press plates and guided on said press frame, means for arresting said blocking elements in adjusted positions along said press frame, and means supporting said blocking elements on said press frame for movement thereof on the press frame transverse to the pressing direction into space provided between said press plates.

5. An apparatus in combination according to claim 4 which includes stationary guiding bars parallel to the direction of relative movement of said plates and slidably supporting said blocking elements.

6. An apparatus in combination according to claim 4 in which said blocking elements comprise spaced finger-like elements extending in the transverse direction and adapted to enter a package in which the articles are being individually compressed from the sides

7. An apparatus in combination according to claim 4 which includes at least one guiding bar on the side of the press frame parallel to the direction of relative movement of said plates along which said blocking elements are slidable and about the axis of which said blocking elements are tiltable.

8. An apparatus in combination according to claim 4 which includes means for supporting a package on said frame which is open at at least one end for receiving articles to be compressed individually and a pressing plate and having longitudinal slots on the sides for receiving blocking elements in the form of transverse fingers.

9. An apparatus in combination according to claim 8 in which said package includes a closure element adapted to latch on said one end of said package.

10. An apparatus in combination according to claim 9 which includes means for braking the opening movement of the closure element slowed down when the latch is released and the articles compressed in the package commence to expand through the said one end of the package.

* * * * *